US006543653B2

(12) United States Patent
Lamboux

(10) Patent No.: US 6,543,653 B2
(45) Date of Patent: Apr. 8, 2003

(54) DEVICE FOR DISPENSING A PRODUCT COMPRISING A RESERVOIR HOUSED IN A CASING

(75) Inventor: Jean-Philippe Lamboux, Saint Aubin les Elbeuf (FR)

(73) Assignee: Techniplast, Louviers (FR)

( * ) Notice: Subject to any disclaimer, the term of this patent is extended or adjusted under 35 U.S.C. 154(b) by 0 days.

(21) Appl. No.: 09/913,357

(22) PCT Filed: Dec. 11, 2000

(86) PCT No.: PCT/FR00/03464

§ 371 (c)(1),
(2), (4) Date: Aug. 13, 2001

(87) PCT Pub. No.: WO01/44076

PCT Pub. Date: Jun. 21, 2001

(65) Prior Publication Data

US 2002/0134798 A1 Sep. 26, 2002

(30) Foreign Application Priority Data

Dec. 13, 1999 (FR) ..... 99 15649

(51) Int. Cl.[7] ..... B67D 5/40
(52) U.S. Cl. ..... 222/321.8; 222/382
(58) Field of Search ..... 222/183, 321.2, 222/321.7, 321.8, 321.9, 325, 381, 382

(56) References Cited

U.S. PATENT DOCUMENTS

| | | | | |
|---|---|---|---|---|
| 4,315,582 A | | 2/1982 | Micallef | 222/148 |
| 5,147,075 A | | 9/1992 | Regan | 222/402.15 |
| 5,516,006 A | * | 5/1996 | Meshberg | 222/162 |
| 6,089,410 A | | 7/2000 | Ponton | 222/183 |
| 6,186,369 B1 | * | 2/2001 | Rosenthal | 222/321.7 |

FOREIGN PATENT DOCUMENTS

| | | |
|---|---|---|
| EP | 0 557 714 A1 | 9/1993 |
| EP | 0 899 213 A3 | 3/1999 |
| EP | 0 899 213 A2 | 3/1999 |
| FR | 2 649 955 | 1/1991 |
| GB | 1 247 947 | 9/1971 |

* cited by examiner

*Primary Examiner*—Joseph A. Kaufman
(74) *Attorney, Agent, or Firm*—Young & Thompson

(57) ABSTRACT

A fluid product dispensing device comprising a reservoir (B), a pump (P) including two pump elements adapted to slide relative to each other in a longitudinal direction and an outer casing (R) provided with a nozzle (10) dispensing the product and an actuator for expelling a dose of product through the nozzle each time an action is exerted by the user of the actuator which comprises a pressing element (7, 8) accessible from outside the casing (R) and a force returning member, the pressing member being mobile substantially transversely to press on the force returning member between two longitudinal end parts, the transformation by the force returning member of the thrust force (F) exerted by the user into a longitudinal sliding force (F2) increasing while the thrust is being exerted.

30 Claims, 9 Drawing Sheets

DEVICE FOR DISPENSING A PRODUCT COMPRISING A RESERVOIR HOUSED IN A CASING

BACKGROUND OF THE INVENTION

The present invention relates to a device for dispensing a fluid, gaseous, liquid or pasty product, of the type comprising a reservoir containing several doses of product, to the neck of which is mounted fixedly a pump equipped with a hollow control stem sliding in a pump body in a direction called longitudinal, and a casing in which said reservoir is housed, said casing being equipped with a nozzle for dispensing the product, connected by a connecting means to said hollow control stem, and with a means for actuating the pump in order to expel a dose of product via the dispensing nozzle on each action exerted by a user on said actuating means.

In spraying product devices, for example atomizers, a precompression stroke or a precompression effect is generally provided, on actuating the pump, in order to liberate the product with enough ejection force to provide a spray of the product at the spray nozzle. The purpose of this precompression stroke of the pump is to force the user to exert, with his finger or his hand, a large force on the actuating button during this precompression stroke. Thus the finger or the hand of the user is carried by its impetus until the button is depressed to the bottom, since, beyond the precompression stroke, the product can be ejected by the pump and therefore the button is less resistive to its depression. It is possible to expel the whole dose of product at high speed, when the force exerted by the user exceeds the precompression value, which may be, for example, about 25 N.

When it is desired, for size, ergonomic or other reasons, that the actuating member is moved in a direction other than that of the stroke of the control stem of the pump, it is possible to provide between them an inclined double-ramp system, a first ramp interacting with the actuating means, a second ramp being connected to the control stem of the pump, so that the gliding of the two ramps one against the other causes the control stem to slide in the pump body. However, in such a system, the friction between the two ramps is great enough so that after the precompression stroke, the user's finger is not driven enough by its impetus to press to the bottom on the actuating means, but is impeded by the resistive force of friction between the ramps. There is therefore no tilting effect after the precompression stroke, which leads to expelling the complete dose of product at a speed which is high enough to ensure that it is sprayed. In order to reduce this friction, it is possible to provide ramps with a shallow slope, but in this case the actuating stroke is too large. If ramps with a shallower slope are chosen, the actuating stroke is smaller, but in this case friction is very great.

Document U.S. Pat. No. 4,315,582 describes a pump system, in a variant of which the pump is actuated by a trigger assembly comprising a pivotally-mounted trigger and a Y-shaped element. This system has a complex outer shape with projecting moveable parts which are accessible from the outside, which increases the risk of inadvertent dismantling and is detrimental to its ergonomics. Furthermore, it does not relate to dispensing devices comprising a casing in which a reservoir equipped with a pump is housed.

SUMMARY OF THE INVENTION

The aim of the invention is to remove the aforementioned drawbacks and to provide a device for dispensing product comprising a reservoir equipped with a pump and a casing in which said reservoir is housed, which makes it possible to eject the product at a high enough speed, and in which the position of the dispensing nozzle is independent of the position of the means for actuating the pump.

To this end, the subject of the invention is a device for dispensing a fluid, gaseous, liquid or pasty product, comprising a reservoir containing several doses of product, a pump comprising two pump elements, that is a hollow stem and a pump body fitted onto said reservoir, said two elements being capable of sliding one with respect to the other in a direction called longitudinal in order to pump said product, and an outer casing equipped with a nozzle for dispensing the product, which nozzle is connected by a connecting means to said hollow stem, and with a pump actuating means to expel a dose of product via the dispensing nozzle on each action exerted by the user on said actuating means, said actuating means comprising a bearing member which is accessible from the outside of the casing and a member for transmitting force, said member for transmitting force having two longitudinal end parts, one, called moveable, of which is capable of bearing on one of said two pump elements in order to make it slide longitudinally and the other, called stationary, of which is locked in translation with respect to said outer casing in the aforementioned longitudinal direction, it being possible for said bearing member to move essentially transversely in order to bear on said member for transmitting force between said two longitudinal end parts, so as to be able to deform said member for transmitting force between a rest position, in which at least one intermediate portion of said transmission member has a nonzero curvature, and an active position, in which the curvature of said intermediate portion is small, in order to increase the longitudinal extension of said member for transmitting force by causing a sliding of said hollow stem toward the inside of said pump body, characterized in that said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, which makes it possible to ensure that said longitudinal sliding force ejects the dose of product at a velocity which is high enough to provide a spray via said nozzle.

In addition, in the aforementioned previous system, the forces to which the Y-shaped element is subjected are large because of the acute angle between its two members at the start of the stroke, such that the stabilization of the Y-shaped element and the fatigue at the junction of the members are problematical.

According to a particular characteristic of the invention, said member for transmitting force comprises two toggle joint lever arms hinged directly or indirectly one with respect to the other at said intermediate portion, the free ends of the two arms opposed to said hinge forming respectively said longitudinal end parts of said member for transmitting force, said two arms forming together an obtuse angle in said rest position and remaining unaligned in said active position, without going through an aligned position of the two arms.

Advantageously, the two toggle joint lever arms are hinged via a central piece guided transversely in translation in said casing.

Advantageously, the bearing member is integral with the hinge between the two aforementioned arms.

Advantageously, the bearing member is able to bear on said member for transmitting force on either side of said toggle joint hinge, on reinforcing ribs carried by the two toggle joint lever arms.

Preferably, the free end of the toggle joint lever arm which forms said stationary end of the member for transmitting force is hinged about a fixed point of the casing.

As a variant, the free toggle joint lever arm end which forms said stationary end of the member for transmitting force is able to be displaced in translation in a substantially transverse direction of the casing, the corresponding toggle joint lever arm being able to act as bearing member.

Advantageously, said member for transmitting force comprises two additional arms hinged respectively to each of said toggle joint lever arms at the free ends thereof, said additional arms being hinged together at their respective ends opposite said toggle joint lever arms in order to form a hinged quadrilateral.

Preferably, the hinge of said additional arms of the quadrilateral is kept transversely in gliding contact with a substantially longitudinal guiding rib of said device in order to be able to slide against said guiding rib during the actuation of said pump.

Advantageously, that one of said additional arms which is hinged to said stationary end of the member for transmitting force is stopped against an oblique stop rib of said device in said rest position.

Preferably, said guiding rib and said stop rib are formed contiguously on an inner face of said casing.

According to another characteristic of the invention, said member for transmitting force comprises an elastically deformable cylindrical sleeve arranged with its axis in a direction which is substantially transverse and substantially perpendicular to the direction of the bearing force of said bearing member, said sleeve exhibiting in said rest position a substantially elliptical section, the major axis of which coincides with the direction of said bearing force and the minor axis of which coincides with said longitudinal direction, the ends of said minor axis forming respectively said longitudinal end parts of said member for transmitting force, said sleeve being deformed during the thrust exerted by the user on said bearing member such that its major axis is shortened whilst its minor axis is elongated.

Preferably, the parts of said sleeve at the ends of said major axis are respectively in gliding contact with a longitudinal wall of said bearing member and with a substantially longitudinal guiding rib of said casing.

Advantageously, said stationary end part of the member for transmitting force is offset with respect to the axis of said hollow stem.

Advantageously, said first pump element is said hollow stem, said movable end part of the member for transmitting force is hinged on an end piece mounted fixedly to the free end of the hollow stem in order to bear on said hollow stem, said end piece carrying the aforementioned connecting means.

Preferably, the aforementioned connecting means is a flexible tube or a deformable bellows or one or more pieces which can be moved with respect to the casing.

According to yet another characteristic of the invention, said first pump element is said pump body and said movable end part of the member for transmitting force bears on a substantially transverse wall carried by said pump body, said pump body and said reservoir being moveable in said direction which is longitudinal with respect to said casing.

Preferably, said hollow stem lies on the other side of said transverse wall with respect to said member for transmitting force, the free end of said hollow stem being mounted fixedly in a wall of the casing carrying said nozzle, said connecting means being a duct formed through said casing wall.

Advantageously, the dispensing nozzle is carried fixedly by the casing.

Preferably, the aforementioned bearing member comprises a flexible membrane mounted fixedly in the wall of the casing.

Advantageously, said casing forms an outer packaging completely containing said reservoir. The whole device can then be designed with a simple shape and quite small size, for example a flat parallelepipedal shape, in order to be easily put away in the pocket of an item of clothing. Said reservoir may advantageously be formed from a pocket made of a flexible plastic film.

Preferably, said member for transmitting force is contained in said outer casing. The toggle joint hinge or hinges may be formed by film hinges.

The invention will be better understood, and other aims, details, characteristics and advantages thereof will appear more clearly, during the detailed explanatory description which follows of several embodiments of the invention, given solely by way of nonlimiting illustration, with reference to the appended schematic drawings.

DETAILED DESCRIPTION OF THE PREFERRED EMBODIMENTS

Figure 2:
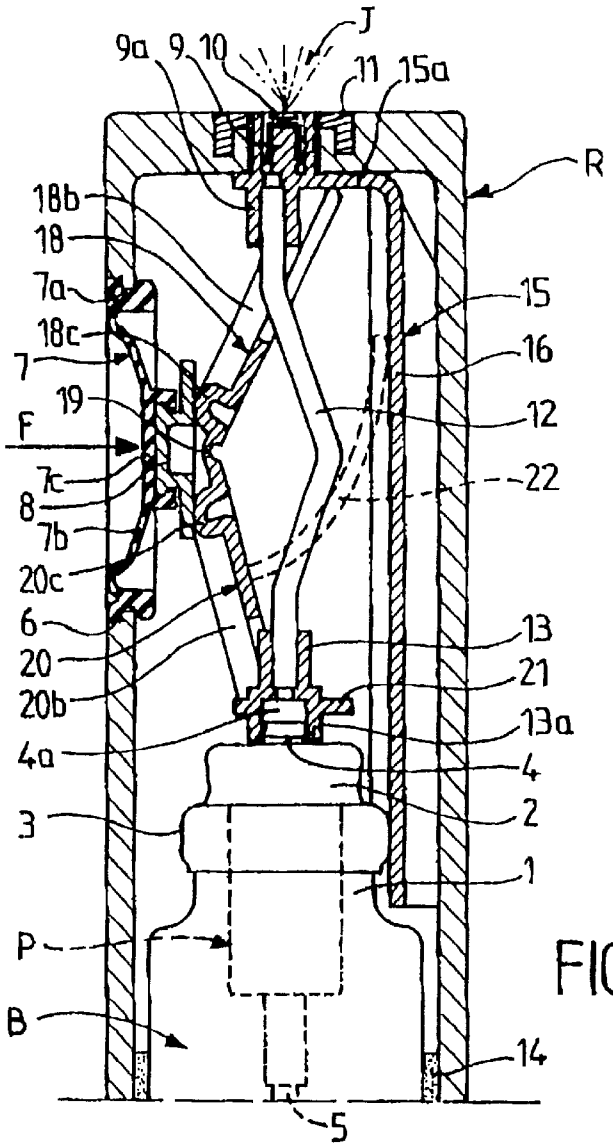
FIG. 2 is a view similar to FIG. 1, but in the active position, at the end of the actuating stroke of the pump.

With reference to FIGS. 1 to 4, a bottle B is seen which is designed to contain several doses of product, the neck 1 of which is equipped with a pump P. The pump P comprises a pump body 2 secured to a collar 3 which is crimped onto the neck 1 of the bottle B and a hollow control stem 4 which is capable of sliding in the pump body 2, in order to eject a dose of product. The pump P is connected to a dip tube 5 which extends down to the bottom of the bottle B (see FIGS. 5 and 6).

The bottle B is housed (at least partially) in a larger container or casing R, for example made of plastic, which forms an outer packaging for the bottle. By way of example, the container R may be made of transparent plastic, with a coat of metalized varnish on the inner surface of the container in order to conceal the inside of the container R. Advantageously, the container R consists of two half-shells made of plastic which are welded one to the other.

Figure 1:
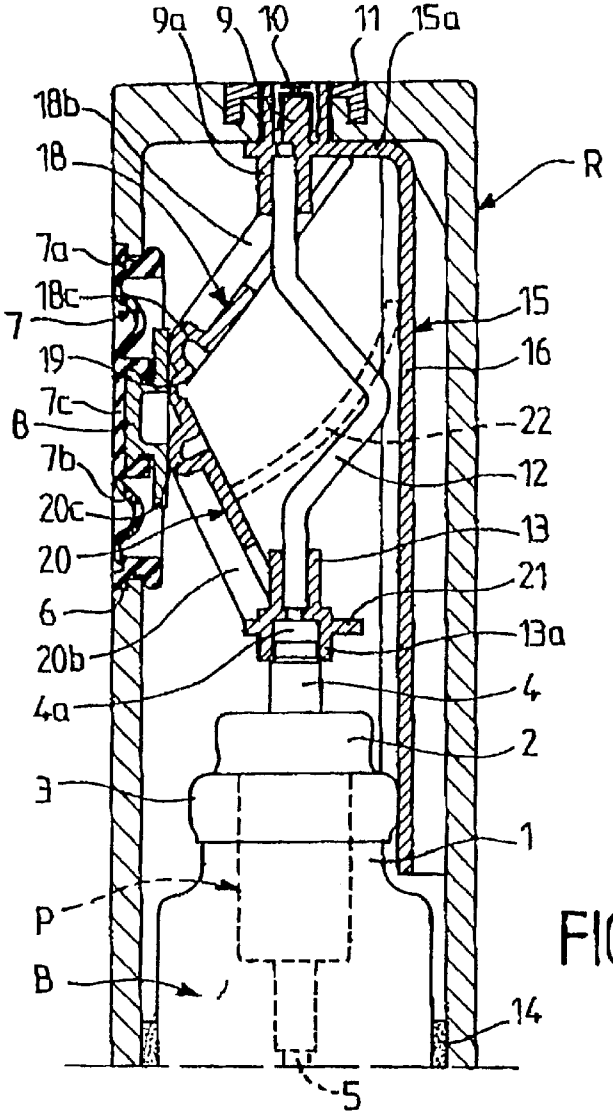
FIG. 1 is a partial view in longitudinal section of a first embodiment of the device according to the invention, in the rest position.

In the variant of FIGS. 1 and 2, the side wall of the container R comprises an opening 6 through which a rubber membrane 7 is forcedly snap-fitted. The rubber membrane 7 comprises a relatively thick cylindrical wall 7*a,* which is designed to be fitted to a shoulder of the aforementioned opening 6 of the wall of the container R, and a portion substantially in the shape of a flexible disk 7*b* of small thickness lying inside said thick cylindrical wall 7*a,* said membrane 7 comprising, in its center, a thicker portion 7*c* making a housing to receive and retain the head of a substantially mushroom-shaped plastic pushing device 8.

At its top, the container R comprises a housing in which an end piece 9, capable of receiving a spray nozzle 10, known per se, is mounted. A locking ring 11 is mounted around the end piece 9 in the thickness of the top wall of the container R in order to lock the end piece 9 in place on the wall of the container. The upper end piece 9 extends inside the container R via an offset cylindrical end piece 9*a* which is capable of receiving the upper end of a flexible tube 12, the lower end thereof being fitted in a lower end piece 13, which is extended by another coaxial end piece 13*a* which is mounted on the smaller-diameter upper end 4*a* of the aforementioned control stem 4.

As is visible in FIGS. 1 and 2, foam 14 is inserted between the bottle B and the inner wall of the container R in order to hold the bottle in place.

Figure 4:
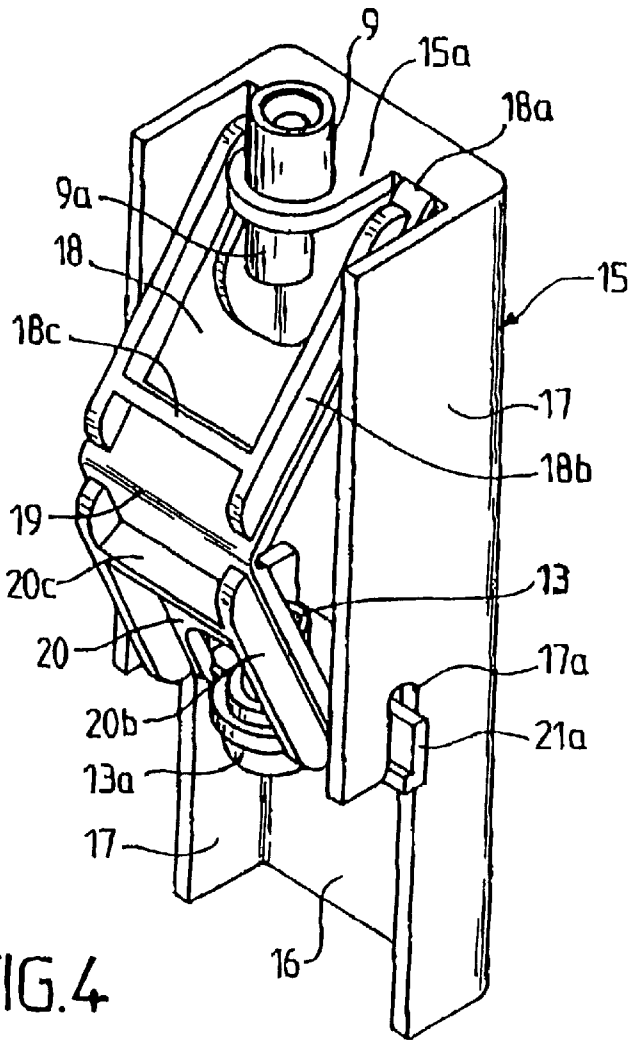
FIG. 4 is a perspective view similar to FIG. 3, but showing said mounting piece in a folded service position.
Figure 3:
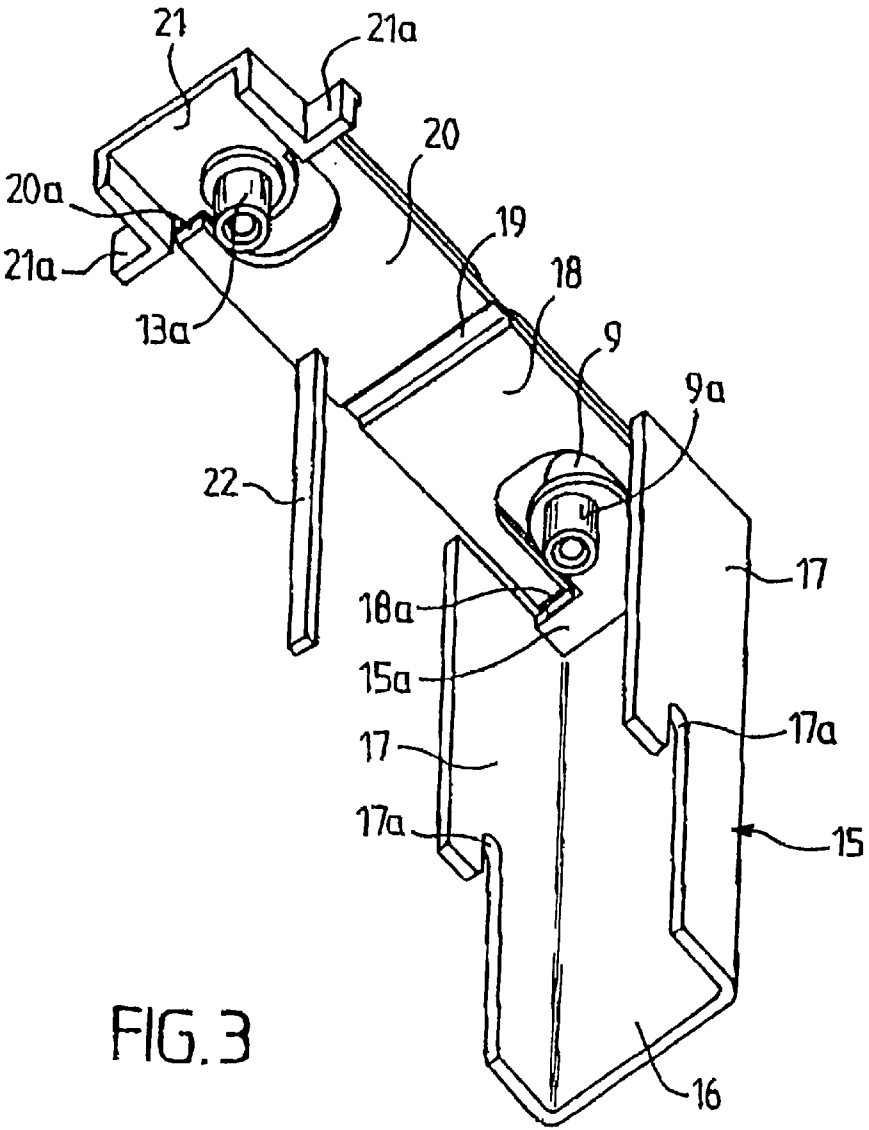
FIG. 3 is a perspective view of a mounting piece designed to be inserted into the container of FIG. 1, said mounting piece being in its position as molded.

As is more visible in FIGS. 3 and 4, the upper end pieces 9 and 9*a* are borne by a substantially horizontal lug 15*a,* which is an integral part of a support member 15. The support member 15 consists of a flat vertical plate 16 with raised side edges 17, the flat plate 16 being designed to bear against an inner side wall of the container R. The aforementioned upper lug 15*a* is connected, on either side of the aforementioned end pieces 9 and 9*a,* to a first U- or fork-shaped arm 18, via two film-hinges 18*a*. The opposite end of the first arm 18 is connected via a hinge 19 to a second arm 20, also substantially U-shaped. The two arms 18 and 20 and the hinge 19 together form a means of transmitting force through an angle using a toggle joint. The overall shape of the toggle joint is an H, hinged on the horizontal bar of the H. The two branches of the second fork-shaped arm 20 are connected via a film hinge 20*a* to a small plate 21 which bears on either side of its plane the aforementioned lower end pieces 13 and 13*a*. The small plate 21 also comprises two side lugs 21*a* which are designed to engage in a groove 17*a* made in the aforementioned raised edges 17 of the support member 15. The grooves 17*a* serve to guide the sliding of the control stem 4.

Each arm 18, 20 comprises side reinforcement ribs 18*b,* 20*b* and a transverse reinforcement rib 18*c,* 20*c,* in the vicinity of the hinge 19.

The second arm 20 may also comprise a flexible tongue 22 which is capable of bearing against the bottom of the plate 16, in the mounted position, as shown in broken line in FIG. 1, in order to provide the elastic return movement of the toggle joint to its rest position.

Advantageously, the support member 15 is in one piece with the end pieces 9, 9*a,* the toggle joint 18 to 20, the small plate 21 and the end pieces 13 and 13*a* and, where necessary, the elastic tongue or tongues 22. In the position illustrated in FIG. 3, the whole of the aforementioned support member 15 is shown in its position as obtained on being taken from the mold. The entire support member is therefore molded. Note, in FIG. 3, that the demolding direction is substantially vertical, and that the arms 18 and 20 forming the toggle joint are in a position aligned both with the small plate 21 and the lug 15*a*.

Figure 19:
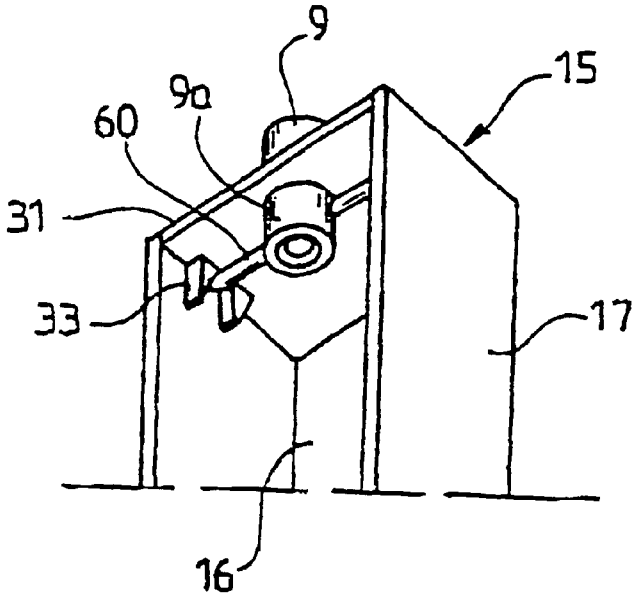
FIG. 19 is a partial view in perspective of the mounting piece of FIG. 3 in another variant embodiment.
Figure 20:
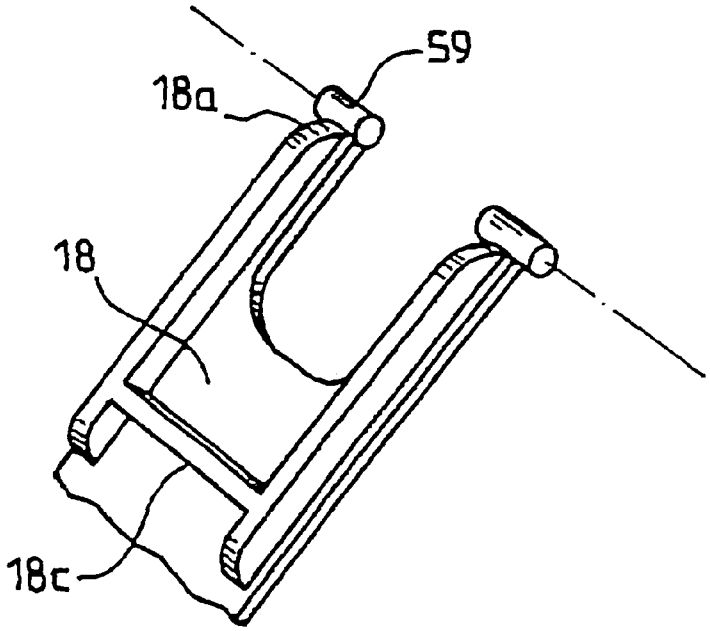
FIG. 20 is a partial view in perspective of a variant embodiment of the toggle joint of FIG. 4 corresponding to the mounting piece of FIG. 19.

In a variant shown in FIGS. 19 and 20, on the one hand the support member 15 with the plate 16, the raised edges 17 and the end pieces 9 and 9*a* and, on the other hand, the toggle joint 18 to 20, the small plate 21 and the end pieces 13 and 13*a,* together with, if required, the elastic tongue or tongues 22, form two distinct assemblies obtained separately by molding. In this case, the first arm 18 comprises at each fork end 18*a* a cylinder 59 arranged transversely in order to form a pivot pin for the arm 18 instead of the film hinges. The lug 15*a* of the support member 15 is, in this case, replaced by an upper wall 31 which completely closes the support member 15 from one edge 17 to the other, this upper wall still bearing the aligned end pieces 9 and 9*a* and, on its lower face, on each side of the end piece 9*a,* there are two longitudinal lugs 33 between which the wall 31 has a transverse recess 60, the lugs 33 and the recess 60 forming a substantially semicylindrical bearing in which each pivot pin 59 of the arm 18 is engaged in order to form a pivot connection.

The operation of the device according to the invention will now be briefly described with reference to FIGS. 1, 2 and 10.

Figure 10:
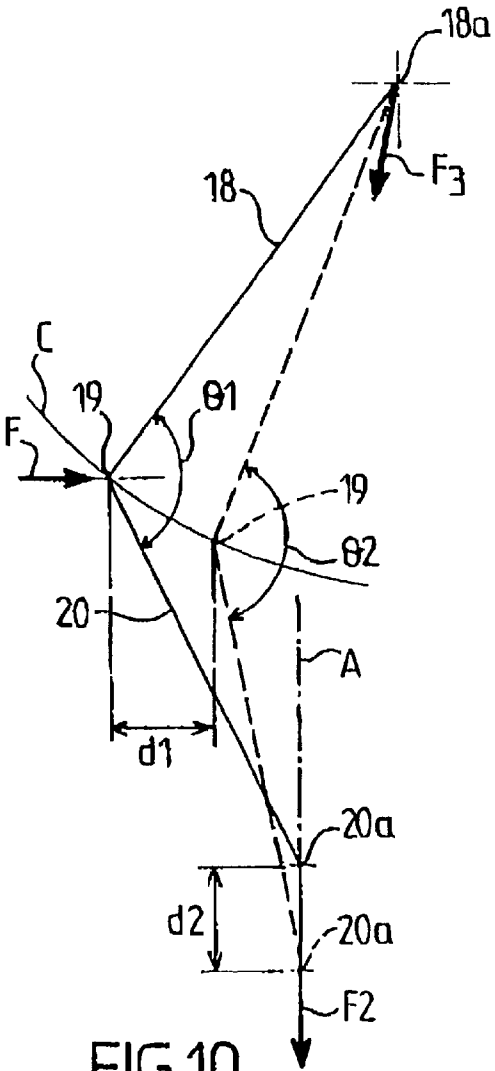
FIG. 10 is a vector diagram showing the actuating forces on sliding the control stem of the pump with a device according to the invention.

In the rest position illustrated in FIG. 1, the control stem 4 of the pump P is in an upward-projecting position and the toggle joint has an opening angle θ1 between the arms 18 and 20, for example of the order of 115° in FIG. 10. In this position, the pushing device 8 bears against the transverse ribs 18*c* and 20*c* of the two arms 18 and 20, on either side of the hinge 19, without however coming into contact with said hinge. If a leaf spring 22 has been provided, the latter is slightly folded with its free end bearing against the bottom of the plate 16, as shown in FIG. 1. The flexible tube 12 has a shape substantially bent into a V inside the container R.

When a user exerts a bearing force F on the central portion 7*c* of the membrane 7, to the right of the pushing device 8, the membrane 7 is deformed toward the inside of the container, to take a substantially concave shape, with the concavity turned outward by virtue of its curved shape in its rest state, as is visible in FIG. 2. The pushing device 8 then bears on the aforementioned ribs 18*c* and 20*c* in order to push back the arms 18 and 20. However, as the upper end 18*a* of the first arm 18 is fixed with respect to the container R, it is the lower end 20*a* of the second arm 20 which is moved downward, depressing the control stem 4 inside the pump body in order to expel a dose of product toward the spray nozzle 10, the jet of sprayed product being shown by J. The flexible tube 12 is deformed to take a more elongated position. As is visible in FIG. 2, the two arms 18 and 20 take a relative position which is more aligned than is the case in FIG. 1, without however being completely aligned, so as to prevent the two arms 18 and 20 from tilting to the other side of their unstable alignment position. It will also be noted that the upper end 18*a* of the first arm 18 is not aligned with the axis of the control stem 4, although that can be envisioned. In the end-of-stroke position where the product is ejected, shown in FIG. 2, the two arms 18 and 20 together form an angle θ2 of about 145° in FIG. 10. By way of example, the pushing device 8 is displaced by a distance d1 of about 4 mm in a transverse direction in order to move the hinge 19 between its two positions illustrated in FIG. 10, and the lower end 20*a* of the second arm 20 is displaced over a height d2 of about 4 mm. We therefore have a system for transmitting force in which a transverse bearing force F is transformed into a longitudinal or vertical displacement force F2.

In FIG. 10, the balance of forces on the actuating member is shown in a vector diagram. F denotes the transverse bearing force exerted by the user and transmitted by the pushing device substantially at the hinge 19. The force F3 is the reaction of the support member 15 on the free end 18*a* of the first arm 18, at the pivot connection. The force F2 exerted on the control stem 4 by the free end 20*a* of the second arm 20 is the longitudinal resultant which causes the control stem 4 to slide in the pump body 2, against pressure and other forces which resist it. F may, for example, have a value of about 35.7 N, F3 a value of about 21.6 N and F2 a value of about 25 N. The point 18*a* may be offset by about 4 mm with respect to the longitudinal axis A of the control stem.

Given that the toggle joint opens during the transverse stroke of the pushing device, the transformation of the pushing force F exerted by the user into a longitudinal sliding force F2 exerted on the control stem increases throughout the push. This is because the leverage from the pushing force F with respect to the pivot pin of the second arm 20 at its end 20*a* increases during the stroke of the hinge 19, represented by an arc of a circle C, while the leverage with respect to the hinge 19 from the forces which resist sliding of the stem 4 decrease. Thus, for resistive forces of constant value, the thrust F needed to overcome said resistive forces, and therefore to actuate the pump P, decreases. This increasing transmission effect combines with the pre-compression effect of the pump to result in a resistive force opposing the thrust by the user which decreases during the pushing stroke.

Once the initial resistive force is overcome, the movement of the user therefore tends to continue by entrainment, causing acceleration of the pushing device, which makes it possible to provide a pressure for ejecting the dose of product which is enough to cause satisfactory spraying or atomization of the jet J by the spray nozzle 10.

When the user releases the pressure exerted on the pushing device 8, the spring integral to the pump may automatically push back the toggle joint to its rest position; however, it is also possible to provide one or more flexible leaves 22 in order to contribute to returning the toggle joint to its rest position.

The vertical sliding of the small plate 21 is guided by the lugs 21*a* which slide in the grooves 17*a* of the edges 17 of the support member 15.

Figure 5:
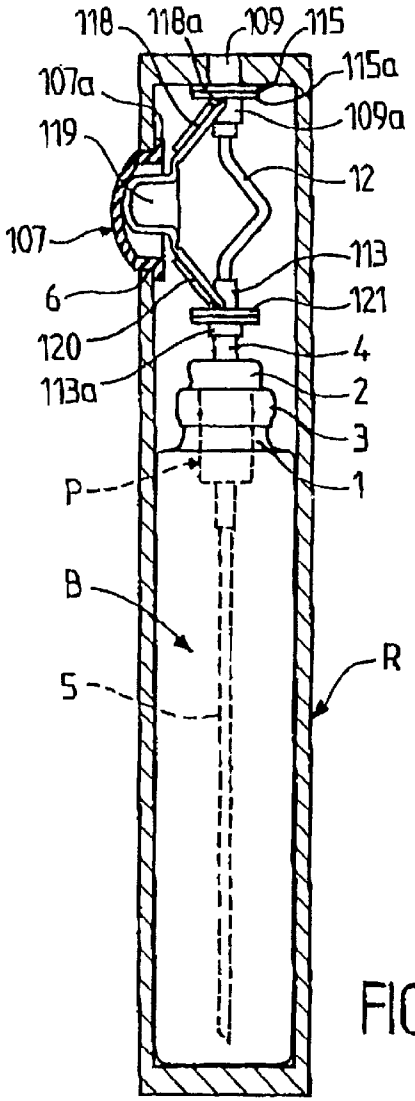
FIG. 5 is a schematic view in longitudinal section of a second embodiment of the device according to the invention, in its rest position.
Figure 6:
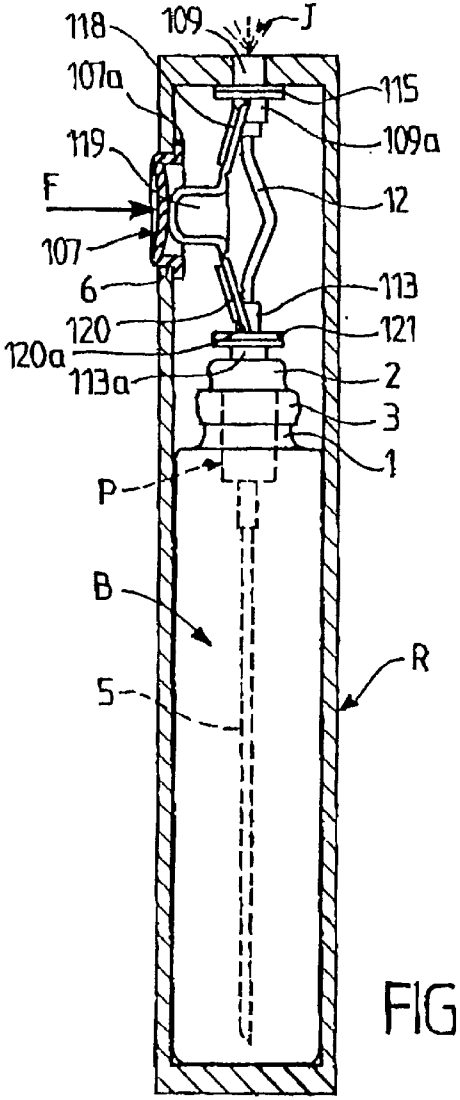
FIG. 6 is a view similar to FIG. 5, but in the active position, at the end of the actuating stroke of the pump.

In the variant illustrated in FIGS. 5 and 6, the same reference numbers are used to denote identical pieces, while similar elements are represented by reference numbers increased by 100.

In this variant, the aforementioned support member is removed, the upper end pieces 109, 109*a* being borne by a small plate 115 fixed directly to the upper wall of the container R, and the lower end pieces 113 and 113*a* being borne directly by the control stem 4 of the pump P. Here, the toggle joint consists of an upper arm 118 hinged at 118*a* to an upper washer 115*a* mounted fixedly under the aforementioned small plate 115, of a lower arm 120 hinged at 120*a* to a lower small plate 121, the two arms 118 and 120 being hinged to a central piece 119 which then acts as a pushbutton. The end pieces 113 and 113*a* project on either side of the small plate 121. This central piece 119 is in contact with a membrane 107 having a substantially spherical-cap shape which is inserted through the opening 6 in the wall of the container R. This membrane 107 comprises a flange which projects peripherally at its base 107a while its central spherical portion projects outward from the container. Advantageously, the central piece 119 is guided in a transverse direction (by means not shown) in order to prevent said piece 119 from tilting about one of its hinges connecting it with the arms 118 and 120. So, if the user exerts a force F, as indicated in FIG. 6, on the membrane 107, which leads to giving it a substantially concave depressed shape, the piece 119 is moved transversely so as to open the angle formed by the toggle joint, but not so far that said piece tilts upward or downward, which otherwise would not allow the vertical sliding movement to be transmitted to the control stem 4.

Otherwise, the operation of the variant illustrated in FIGS. 5 and 6 is similar to that of the first variant.

Figure 7:
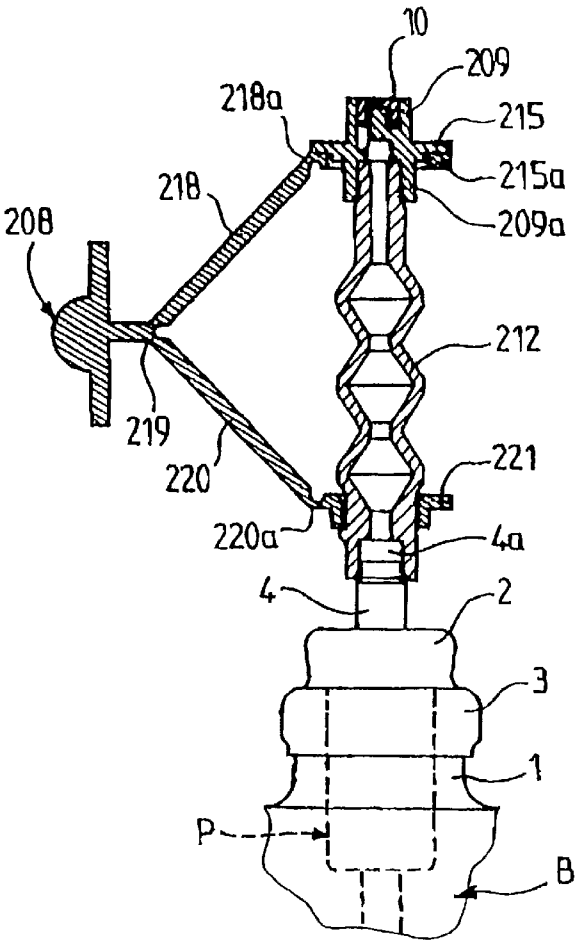
FIG. 7 is a partial view in longitudinal section of a third embodiment of the device according to the invention, in the rest position.

A third variant is illustrated in FIG. 7, in which the elements identical to those of the first variant bear the same reference numbers, while similar elements bear the reference numbers increased by 200.

In FIG. 7, the aforementioned flexible tube is replaced by an elongated bellows 212, the upper end of which is fitted in an upper end piece 209*a* and the lower end of which is directly fitted on the free end 4*a* of the control tube 4 of the pump P. The upper end piece 209*a* is borne by a small plate 215, from the other side of which the end piece 209, intended to receive the spray nozzle 10, is made to project. Under this small plate 215, a washer 215*a* is mounted, which washer is extended by a film hinge 218*a* of the first arm 218 of the toggle joint. The other end of the first arm 218 is connected via the hinge 219 to the second arm 220, the lower end of which is connected via a film hinge 220*a* to a small plate 221 which is mounted around the lower end of the bellows 212. The aforementioned hinge 219 is extended by a pushing device 208 which can be directly accessible from the outside of the container (not shown in FIG. 7).

The operation of this variant remains similar to that of the two aforementioned variants.

Figure 9:
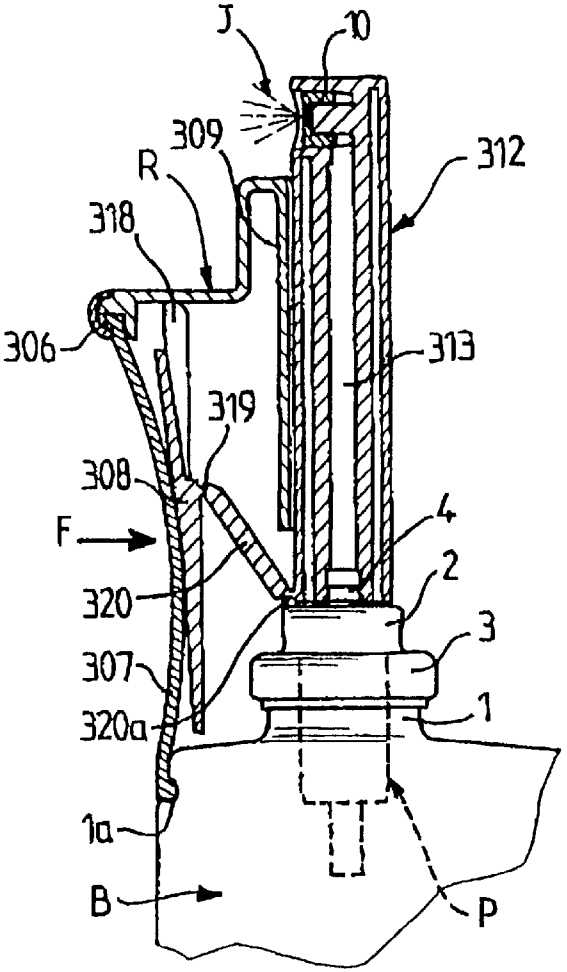
FIG. 9 is a view similar to FIG. 8, but in the active position, at the end of the actuating stroke of the pump, the spray nozzle being secured in translation with the control stem of the pump.
Figure 8:
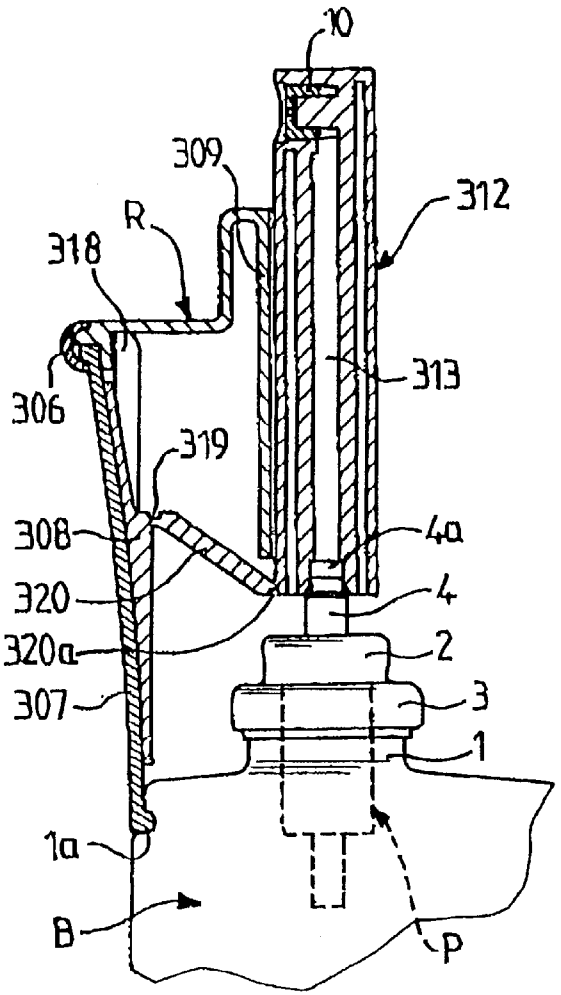
FIG. 8 is a partial view in longitudinal section of a fourth embodiment of the device of the invention, in the rest position.

FIGS. 8 and 9 show a fourth variant, in which the spray nozzle 10 is borne by a moveable hollow connecting piece 312 of elongated shape which is borne directly at its lower end by the control stem 4 of the pump P. This moveable piece 312 comprises an axial passage 313 which opens out at its lower end onto the hollow control stem 4 and at its upper end onto the spray nozzle 10 which here is positioned perpendicularly to the axis of the container R. This piece 312 is capable of sliding vertically with respect to a guide sleeve 309 which extends into the container R from its top. Consequently, in this variant, the outlet nozzle 10 for the product can be moved with respect to the container R, while in the other variants it was stationary with respect to the container.

In addition, in this variant, an elastomeric sleeve is provided over the whole perimeter of the side wall of the container R, so as to be able to be compressed by tightening said sleeve in one hand. In fact, in this variant, the elastomeric sleeve is directly connected at its lower end, in a recess 1*a*, to the top of the bottle B and at its upper end to the upper wall of the container R using a semi-toric retaining ring 306. Inside the container R, that is to say in the space defined between the top of the bottle B and the upper wall of the container R, a plurality of substantially vertical segments 308 are provided, which are regularly distributed over the entire perimeter of the container and are in contact with the inner face of the elastomeric sleeve 307. The segments 308 are capable of being moved radially toward the axis of the device. These segments act as bearing member. Each segment 308 is extended by an upper arm 318 which slides in a transverse and radial direction with respect to the axis of the device. This first arm 318 is connected via a hinge 319 to a second lower arm 320 which is connected by a film hinge 320*a* to the aforementioned piece 312. The arm 318, the hinge 319 and the second arm 320 together form a toggle joint, in the sense of the invention.

In this variant, the piece 312, the toggle joint and the pushing device 308 form a single molded piece.

Figure 11:
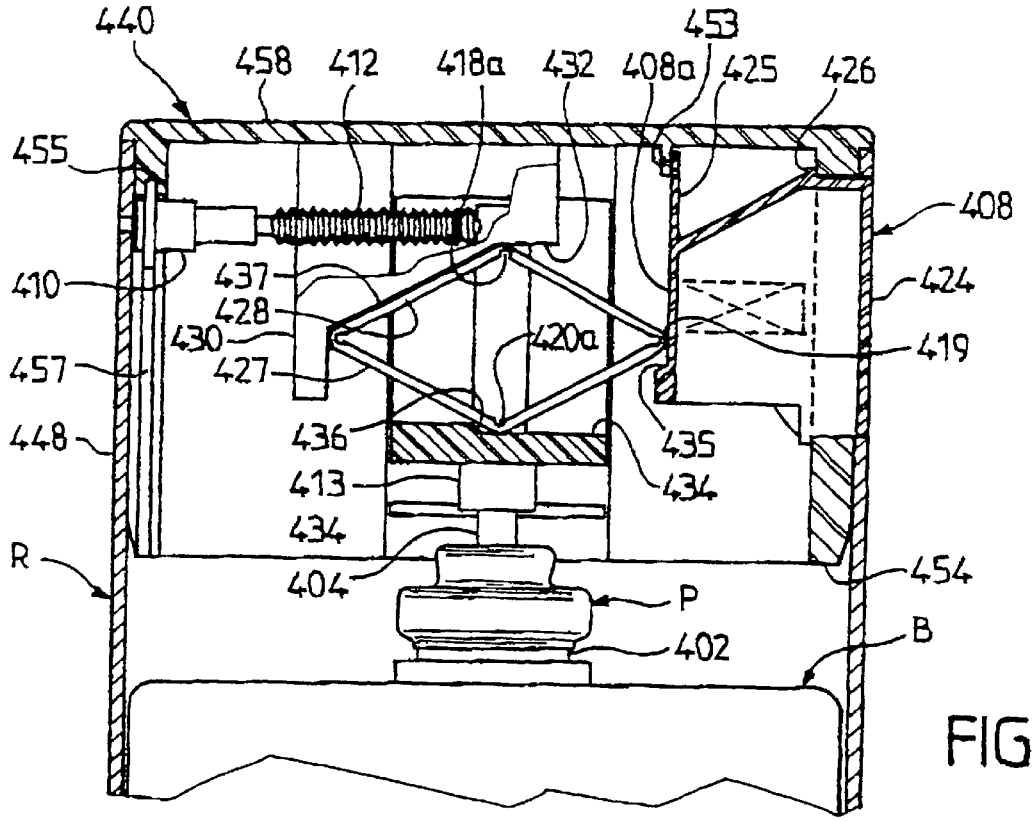
FIG. 11 is a partial view in longitudinal section of a fifth embodiment of the device of the invention, in the rest position.
Figure 12:
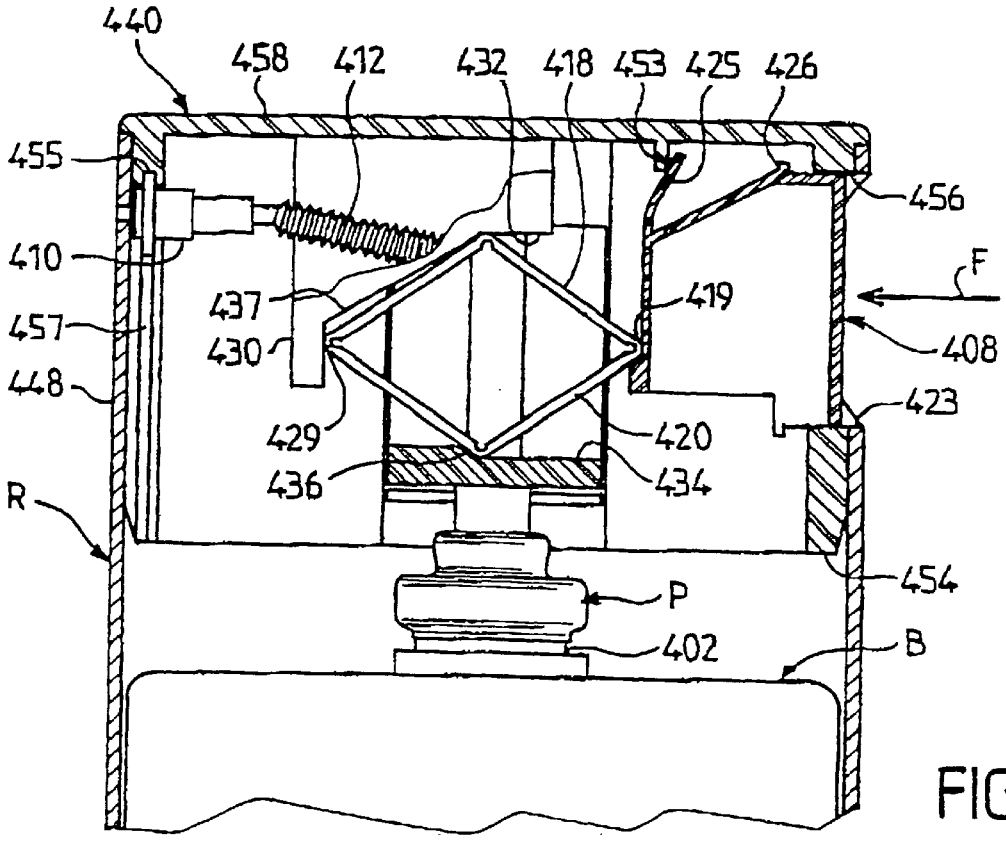
FIG. 12 is a view similar to FIG. 11, but in the active position, at the end of the actuating stroke of the pump.

A fifth embodiment of the invention will now be described with reference to FIGS. 11 and 12. The elements similar or identical to those of the first embodiment bear the same reference number increased by 400.

In this variant, the casing R is formed by a container 448 in which the bottle B is housed and by a lid 440 fitted on the container 448 in order to close its longitudinal end face in the extension of the pump stem 404. The lid 440 has a substantially flat upper wall 458 and an annular sleeve 454 engaged longitudinally in the container 448 in order to hold the lid 440 in place transversely. To the right of the nozzle 410, the sleeve 454 has a longitudinal notch 457 to enable the lid 440 to pass around said nozzle 410 during assembly. A lug for attaching the nozzle 410 is engaged in a transverse groove 455 at the bottom of the notch 457 in order to immobilize the nozzle 410 transversely with respect to the casing R.

The pushbutton 408 is guided in translation transversely into an opening 423 of the side wall of the container 448 and an opening 456 of the sleeve 454 aligned therewith. It has a bearing surface 424 substantially aligned with said side wall in the rest position and depressed in said casing R in the active position. The button 408 comprises an elastic tongue 425 which can be deformed between a substantially straight state in the rest position and a state in which it is bent against a pin 453 of the lid 440 in the active position of the pushing device 408, in order to exert a return force on the latter toward its rest position. In the rest position, a pin 426 of the button 408 comes up against the sleeve 454 of the lid 440.

The longitudinal face 408*a* opposite the bearing face 424 is in gliding contact against the hinge 419 of at least one, and preferably two, toggle joint(s), each one formed by a hinged quadrilateral composed of four arms 418, 420, 427 and 428. While the two arms 418 and 420 correspond to those of the first embodiment, the two arms 427 and 428 are arranged substantially symmetrically to the latter with respect to the longitudinal sliding axis A of the pump stem 404. The hinge 429 opposite the hinge 419 is in gliding contact against a longitudinal rib 430 of the lid 440. The hinge 418*a* between the arms 418 and 428 is in gliding contact with a transverse rib 432. In the rest position, the arm 428 comes up along an oblique rib 437. The ribs 430, 437 and 432 are formed contiguously on the inside of the sleeve 454.

The end piece 413 fitted on the pump stem 404 has a shoulder on which rests a washer 434 on the transverse surface of which rests the hinge 420*a* opposite the hinge 418*a*. The upper end of the end piece 413 opens transversely into the deformable bellows 412 connecting the end piece 413 to the nozzle 410. During a transverse push on the pushbutton 408, the hinge 429 being locked transversely against the rib 430, the transverse extension of the hinged quadrilateral decreases while its longitudinal extension increases. Since the hinge 418*a* is locked by the rib 432, it is the hinge 420*a* which is displaced longitudinally thereby causing, via the washer 434 and the end piece 413, actuation of the pump stem 404. During this movement, the hinge 429 glides against the rib 430, the hinge 418*a* against the rib 432, the hinge 420*a* against the washer 434 and the hinge 419 against the surface 408*a* of the pushing device 408.

At the end of the stroke of the pushing device, the hinge 419 comes up against a step 435 of the surface 408*a* and the hinge 420*a* against a step 436 on the washer 434. The mechanical advantages of the hinged quadrilateral are identical to those of the toggle joint of the first embodiment. This hinged quadrilateral in addition has a greater resistance to fatigue because of the better distribution of forces.

Figure 13:
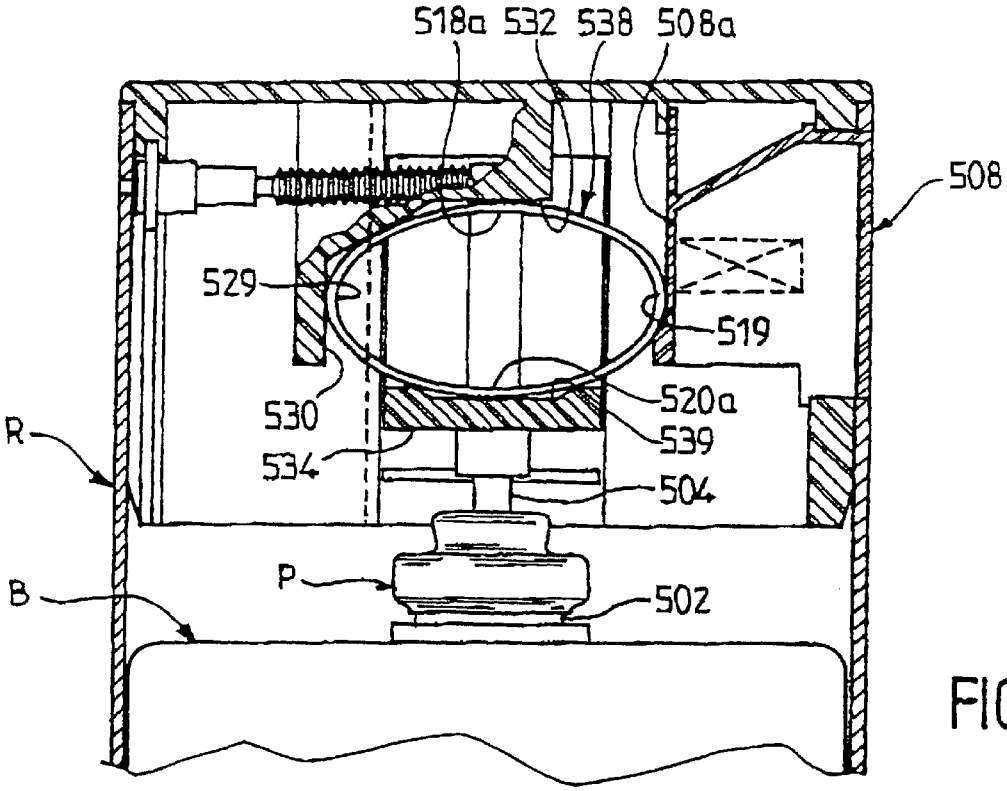
FIG. 13 is a partial view in longitudinal section of a sixth embodiment of the device of the invention, in the rest position.
Figure 14:
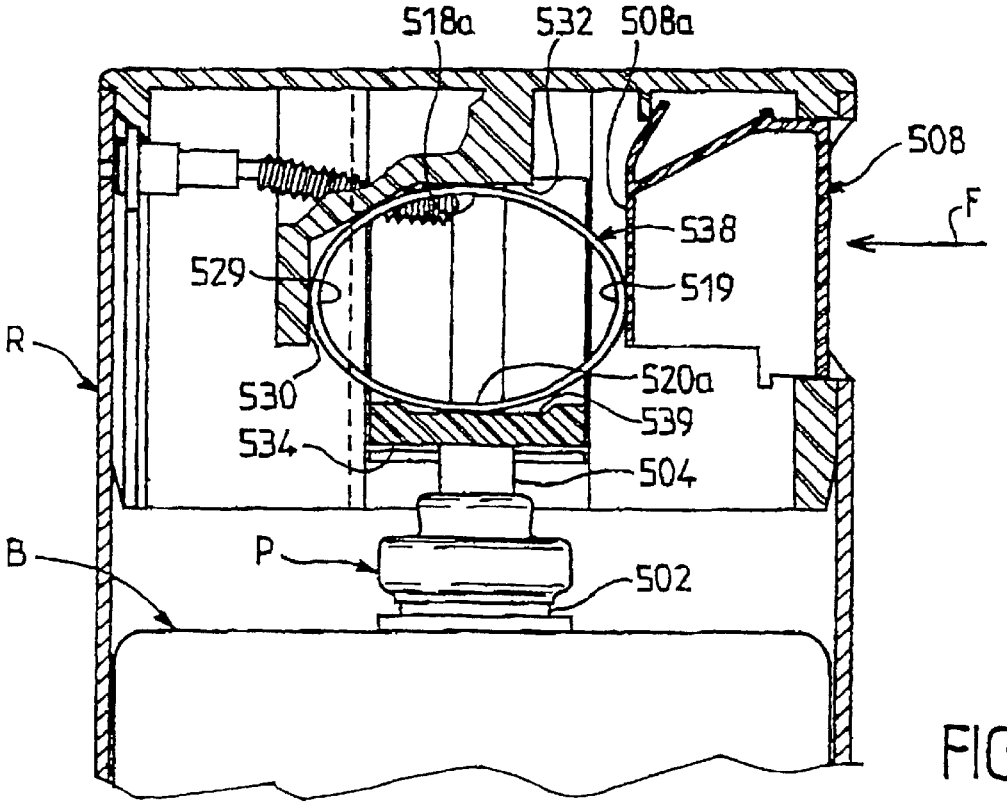
FIG. 14 is a view similar to FIG. 13, but in the active position, at the end of the actuating stroke of the pump.

The sixth embodiment illustrated in FIGS. 13 and 14 differs from the previous one solely in the use of a deformable sleeve in place of each hinged quadrilateral. The elements similar or identical to those of the first embodiment now bear the same reference number increased by 500.

The substantially cylindrical sleeve 538 is placed with its axis in a transverse direction substantially perpendicular to the direction of pushing of the button 508. It has a substantially elliptical section, the major axis of which coincides with the direction of displacement of the pushing device 508 and the minor axis of which coincides with the longitudinal sliding direction of the pump stem 504. When the button 508 is pushed from its rest position to its active position, the parts of the sleeve 538 located at the ends 519 and 529 of said major axis are brought together transversely between the surface 508*a* and the rib 530, respectively. The sleeve 538 of substantially constant perimeter is then deformed by moving the ends 518*a* and 520*a* of said minor axis apart, which causes the washer 534 to move away from the rib 532 and the pump stem 504 to slide in the course [sic] 502. Here, the washer 534 exhibits a central depression 539 designed to stabilize transversely the sleeve 538. The mechanical advantages of the actuating member formed by the sleeve 538 are similar, in terms of transfer of forces, to those of the toggle joint of the first embodiment. Preferably, a similar sleeve is arranged on each side of the pump stem 504.

Figure 15:
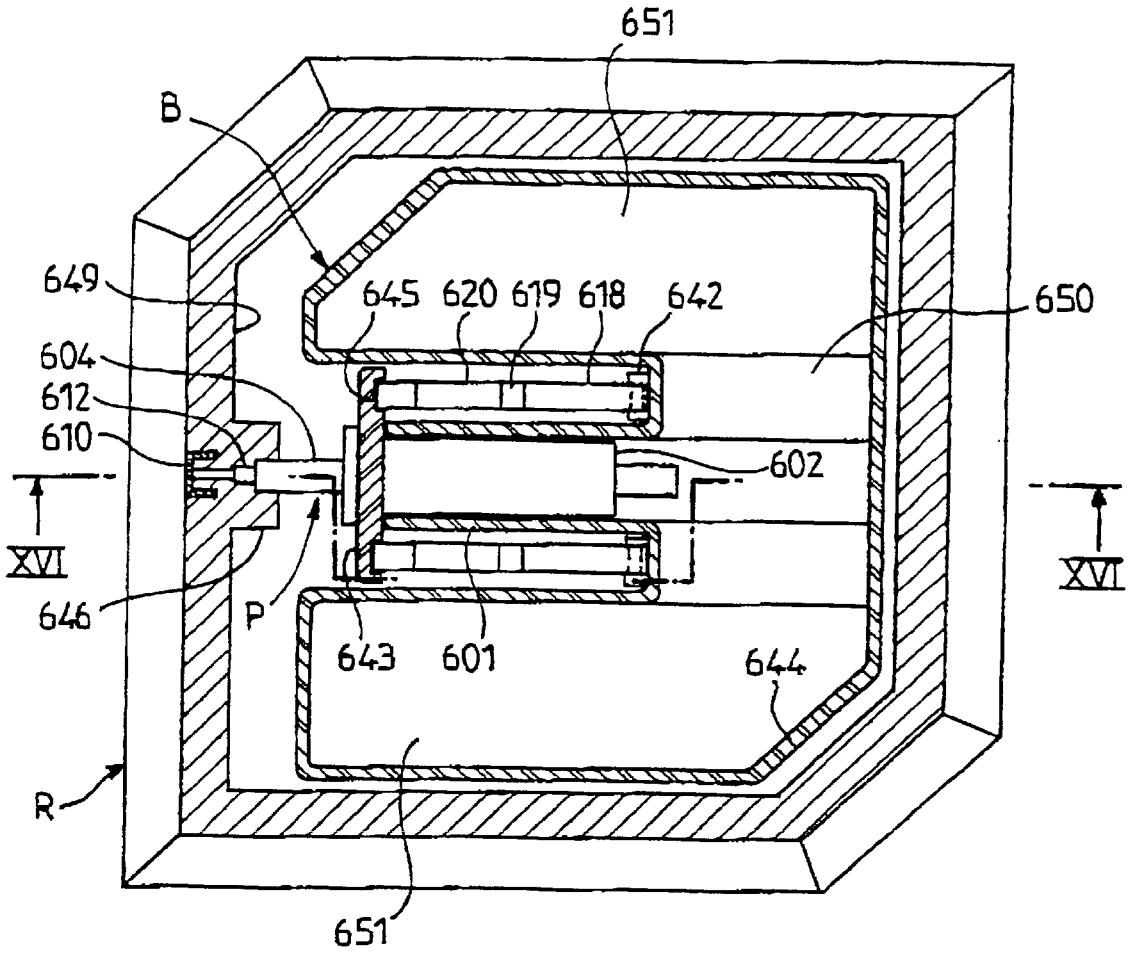
FIG. 15 is a view in longitudinal section, along the line XV—XV of FIG. 16, of a sixth embodiment of the device of the invention, in the rest position.
Figure 16:
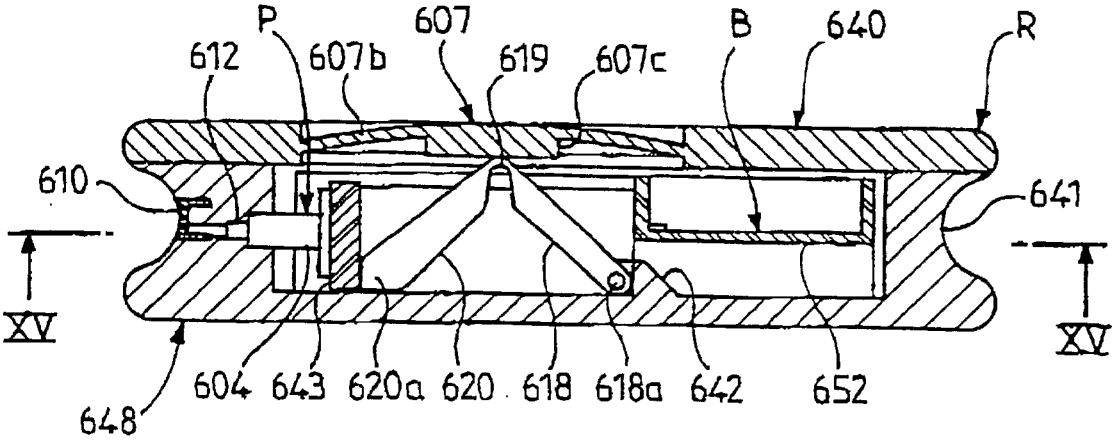
FIG. 16 is a view in longitudinal section, along the line XVI—XVI of FIG. 15, of the device of FIG. 15 in the rest position.

A seventh embodiment of the invention will now be described with reference to FIGS. 15 and 16. The elements similar or identical to those of the first embodiment bear the same reference number increased by 600.

In this variant, the casing R has a shape which is substantially that of a block of square section, two diagonally opposite corners 647 of which are cut substantially perpendicularly to said diagonal and the thickness of which is substantially equal to a quarter of the length. The casing R has a container 648 having at mid-thickness a substantially semicircular outer peripheral groove 641, and is closed on its upper face by a lid 640. The deformable membrane 607 is formed by a substantially central thinned part of the lid 640 and has in its rest position, visible in FIG. 16, a convexity directed outward from the casing R. On its inner face, the membrane bears the thicker portion 607*c* in gliding contact with the hinge 619 of at least one, preferably two, toggle joint(s), each one formed by the two arms 618 and 620.

The nozzle 610 is mounted substantially at mid-thickness in a side wall 649 of the container 648 on the inner face of which the pump control stem 604 is directly engaged. A duct 612 through the wall 649 connects the stem 604 to the nozzle 610. At the level of the duct 612, the wall 649 has a part 646 projecting toward the inside of the casing R. In this embodiment, the bottle is replaced by a reservoir B with rigid wall 644 completely enclosed in the casing R and able to move longitudinally therein under the action of the toggle joint 618 to 620. The reservoir B has a shape substantially in the form of a capital E with a base 650 from which extend longitudinally two side wings 651 and a central throat 601 forming the neck of the reservoir in which the pump body 602 is mounted fixedly.

The throat 601 is closed at its end by a transverse plate 643 through which the pump body 602 passes and which has two end parts projecting transversely from each side of the throat 601 toward the side wings 651. The plate 643 attached to the reservoir B acts as a bearing surface for each arm 620 of the toggle joint whose free end 620*a* is engaged in a notch 645 of the plate 643 in order to form a pivot connection therewith. The other arm 618 of each toggle joint has its free end 618*a* longitudinally locked in translation by a pin 642 formed at the bottom of the container 648. When the toggle joint is opened by a transverse push exerted on the membrane 607, the entire reservoir B and pump body 602 slide longitudinally toward the nozzle 610 around the pump stem 604, thus causing a dose of product to be expelled. In order to slide around the pins 642, the base 650 of the reservoir B has two longitudinal grooves 652. During this sliding, the hinge 619 glides longitudinally over the thick portion 607*c* of the membrane 607. The mechanical advantages of the two toggle joints for this embodiment are similar to those of the first embodiment.

Figure 17:
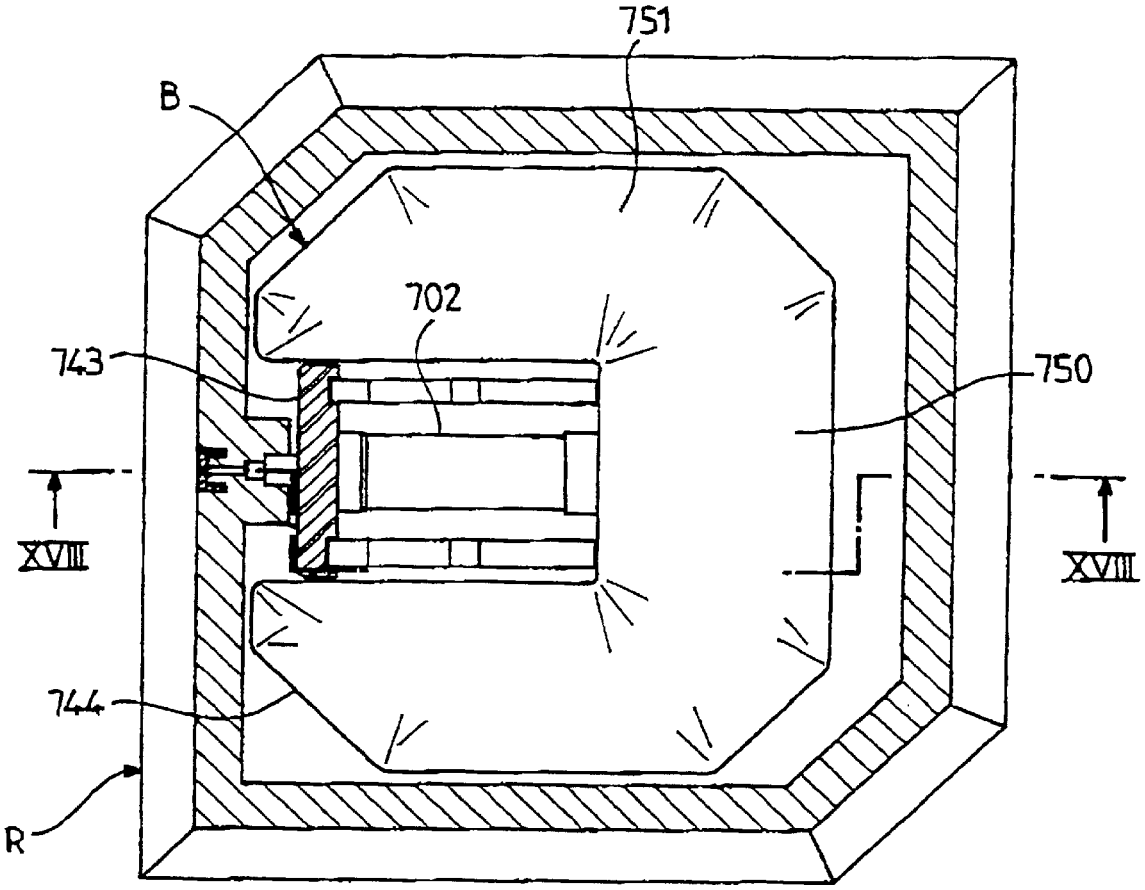
FIG. 17 is a view in longitudinal section along the line XVII—XVII of FIG. 18 of a sixth embodiment of the device of the invention, in the active position, at the end of the actuating stroke of the pump.
Figure 18:
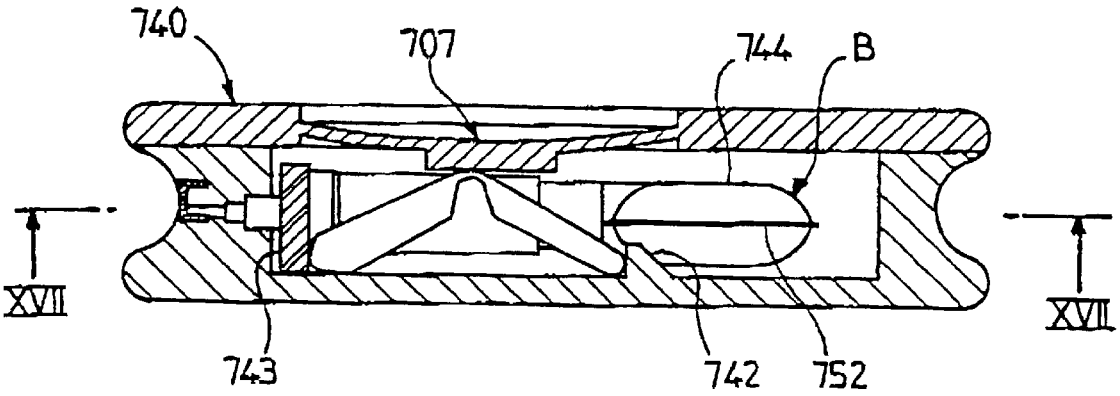
FIG. 18 is a view in longitudinal section, along the line XVIII—XVIII of FIG. 17, of the device of FIG. 17 in the active position, at the end of the actuating stroke of the pump.

The seventh embodiment illustrated in FIGS. 17 and 18 has, compared to the sixth embodiment, a different design of the reservoir B. The elements similar or identical to those of the first embodiment bear the same reference number increased by 700.

In this variant, the reservoir B is formed by a pocket, the wall 744 of which is made of a flexible plastic film. The reservoir B is substantially U-shaped with a base 750 and two side wings 751. The pump body 702 is attached directly to the middle of the base 750 between the two wings 751 and bears the plate 743. Two grooves 752 under the base 750 allow it to slide longitudinally around the pins 742 of the casing R. As is visible in FIG. 18, the membrane 707 has, in the active position, a convexity directed inward from the casing R.

Although the invention has been described in connection with several particular exemplary embodiments, it is quite obvious that it is in no way limited thereto and that it comprises all the technical equivalents of the means described together with their combinations if these fall within the scope of the invention.

What is claimed is:

1. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein said member for transmitting force comprises two toggle joint lever arms hinged directly or indirectly one with respect to the other at said intermediate portion, the free ends of the two arms opposing to said hinge forming respectively said longitudinal end parts of said member for transmitting force, said two arms forming together an obtuse angle in said rest position and remaining unaligned in said active position, without going through an aligned position of the two arms, and wherein the bearing member is able to bear on said member for transmitting force on either side of said toggle joint hinge, on reinforcing ribs carried by the two toggle joint lever arms.

2. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein said member for transmitting force comprises two toggle joint lever arms hinged directly or indirectly one with respect to the other at said intermediate portion, the free ends of the two arms opposing to said hinge forming respectively said longitudinal end parts of said member for transmitting force, said two arms forming together an obtuse angle in said rest position and remaining unaligned in said active position, without going through an aligned position of the two arms, and wherein said member for transmitting force comprises two additional arms hinged respectively to each of said toggle joint lever arms at the free ends thereof, said additional arms being hinged together at their respective ends opposite said toggle joint lever arms in order to form a hinged quadrilateral.

3. Device according to claim 2, characterized in that the hinge (429) of said additional arms (427, 428) of the quadrilateral is kept transversely in gliding contact with a substantially longitudinal guiding rib (430) of said device in order to be able to slide against said guiding rib (430) during the actuation of said pump (P).

4. Device according to claim 3, characterized in that that one of said additional arms (428) which is hinged to said stationary end **(418*a*) of the member for transmitting force is stopped against an oblique stop rib (437)** of said device in said rest position.

5. Device according to claim 4, characterized in that said guiding rib (430) and said stop rib (437) are formed contiguously on an inner face of said casing (R).

6. The device according to claim 2, wherein said casing comprises a lid having a longitudinal notch to enable the lid to pass around said nozzle.

7. The device according to claim 2, wherein said bearing member comprises a pushbutton guided in transverse translation into an opening of a side wall of the casing.

8. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein said member for transmitting force comprises an elastically deformable cylindrical sleeve arranged with its axis in a direction which is substantially transverse and substantially perpendicular to the direction of the bearing force of said bearing member, said sleeve exhibiting in said rest position a substantially elliptical section, the major axis of which coincides with the direction of said bearing force and the minor axis of which coincides with said longitudinal direction, the ends of said minor axis forming respectively said longitudinal end parts of said member for transmitting force, said sleeve being deformed during the push exerted by the user on said bearing member such that its major axis is shortened whilst its minor axis is elongated.

9. Device according to claim 8, characterized in that the parts (519, 529) of said sleeve (538) at the ends of said major axis are respectively in gliding contact with a longitudinal wall (508*a*) of said bearing member (508) and with a substantially longitudinal guiding rib (530) of said casing (R).

10. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein paid reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein the aforementioned connecting means is a flexible tube or a deformable bellows or one or more pieces which can be moved with respect to the casing.

11. Device according to claim 10, wherein said stationary end part of the member for transmitting force is offset with respect to the axis of said hollow stem.

12. Device according to claim 10, wherein said first pump element is said hollow stem, said movable end part of the member for transmitting force is hinged on an end piece mounted fixedly on the free end of the hollow stem in order to bear on said hollow stem, said end piece carrying the aforementioned connecting means.

13. Device according to claim 10, wherein the dispensing nozzle is carried fixedly by the casing.

14. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is small, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein said first pump element is said pump body, said movable end part of the member for transmitting force bearing on a substantially transverse wall carried by said pump body, said pump body and said reservoir being moveable in said direction which is longitudinal with respect to said casing.

15. Device according to claim 14, characterized in that said hollow stem (604) lies on the other side of said transverse wall (643) with respect to said member for transmitting force (618–620), the free end of said hollow stem being mounted fixedly in a wall (649) of the casing (R) carrying said nozzle (610), said connection means being a duct (612) formed through said casing wall.

16. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein the aforementioned bearing member comprises a flexible membrane mounted fixedly in the wall of the casing.

17. Device according to claim 16, wherein said member for transmitting force comprises two toggle joint lever arms hinged directly or indirectly one with respect to the other at said intermediate portion, the free ends of the two arms opposing to said hinge forming respectively said longitudinal end parts of said member for transmitting force, said two arms forming together an obtuse angle in said rest position and remaining unaligned in said active position, without going through an aligned position of the two arms.

18. Device according to claim 17, characterized in that the two toggle joint lever arms (118, 120) are hinged via a central piece, (119) guided transversely in translation in said casing (R).

19. Device according to claim 17, characterized in that the bearing member (208) is integral with the hinge (219) between the two aforementioned arms (218, 220).

20. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein said casing forms an outer packaging completely containing said reservoir.

21. Device according to claim 20, wherein the member for transmitting force comprises two toggle joint lever arms hinged directly or indirectly one with respect to the other at said intermediate portion, the free ends of the two arms opposing to said hinge forming respectively said longitudinal end parts of said member for transmitting force, said two arms forming together an obtuse angle in said rest position and remaining unaligned in said active position, without going through an aligned position of the two arms, and wherein the free end of the toggle joint lever arm which forms said stationary end of the member for transmitting force is hinged about a fixed point of the casing.

22. Device according to claim 20, wherein the member for transmitting force comprises two toggle joint lever arms hinged directly or indirectly one with respect to the other at said intermediate portion, the free ends of the two arms opposing to said hinge forming respectively said longitudinal end parts of said member for transmitting force, said two arms forming together an obtuse angle in said rest position and remaining unaligned in said active position, without going through an aligned position of the two arms, and wherein the free toggle joint lever arm end which forms said stationary end of the member for transmitting force is able to be displaced in translation in a substantially transverse direction of the casing, the corresponding toggle joint lever arm being able to act as bearing member.

23. Device according to claim 20, wherein said reservoir is formed from a pocket made of a flexible plastic film.

24. Device according to claim 20, wherein said member for transmitting force is contained in said outer casing.

25. Device for dispensing a fluid, gaseous, liquid or pasty product, comprising a reservoir containing several doses of product, a pump comprising two pump elements, that is a hollow stem and a pump body fitted onto said reservoir, said two elements being slidable one with respect to the other in a longitudinal direction in order to pump said product, and an outer casing interacting with a nozzle for dispensing the product, said nozzle is connected by a connecting means to said hollow stem, and with a pump actuating means to expel a dose of product via the dispensing nozzle on each action exerted by the user on said actuating means, said actuating means comprising a bearing member that is accessible from the outside of the casing and a member for transmitting force, said member for transmitting force having two longitudinal end parts, a first one of said end parts being movable, and bearing on a first of said two pump elements in order so that said first one of said two pump elements slides longitudinally and a second one of said end parts being locked in translation with respect to said outer casing in said longitudinal direction, said bearing member moving essentially transversely in order to bear on said member for transmitting force between said two longitudinal end parts, so as to be able to deform said member for transmitting force between a rest position, in which at least one intermediate portion of said transmission member has a non-zero curvature, and an active position, in which the curvature of said intermediate portion is smaller, in order to increase the longitudinal extension of said member for transmitting force by causing a mutual sliding of said pump elements, wherein said reservoir is housed at least partially in said casing, said member for transmitting force being arranged such that the transformation, by said member for transmitting force, from the pushing force exerted by the user on said bearing member into a longitudinal sliding force exerted on said first pump element increases throughout the push, so that said longitudinal sliding force ejects the dose of product at a velocity which is high enough to provide a spray via said nozzle, wherein the dispensing nozzle can be moved with respect to the casing.

26. The device according to claim 25, wherein the connecting means is a connecting piece which is borne directly at a lower end thereof by said hollow stem of the pump and is moveable with respect to the casing, said connecting piece comprising an axial passage which opens out at an end thereof onto said hollow stem and at another end thereof onto the dispensing nozzle, wherein said dispensing nozzle is borne by said connecting piece.

27. The device according to claims 26, wherein said member for transmitting force comprises two toggle joint lever arms (18, 20; 118, 120; 213, 220; 318, 320;l[sic] 418, 420; 618, 620) hinged directly or indirectly one with respect to the other at said intermediate portion, the free ends of the two arms opposing to said hinge forming respectively said longitudinal end parts of said member for transmitting force, said two arms forming together an obtuse angle (θ1) in said rest position and remaining unaligned in said active position, without going through an aligned position of the two arms, wherein said connecting piece and said toggle joint lever arms form a single molded piece.

28. The device according to claim 26, wherein said casing comprises a guide means for guiding said connecting piece, said connecting piece being capable of sliding vertically with respect to the guide means.

29. The device according to claims 26, wherein said member for transmitting force comprises two toggle joint lever arms (18, 20; 118, 120; 218, 220; 318, 320; 418, 420; 618, 620) hinged directly or indirectly one with respect to the other at said intermediate portion, the free ends of the two arms opposing to said hinge forming respectively said longitudinal end parts of said member for transmitting force, said two arms forming together an obtuse angle (θ1) in said rest position and remaining unaligned in said active position, without going through an aligned position of the two arms, wherein said pushbutton has a bearing face and a face opposite said bearing face which is in gliding contact against the hinge between said toggle joint lever arms.

30. The device according to claim 25, wherein said dispensing nozzle is positioned perpendicularly to an axis of the outer casing.

* * * * *